US005951763A

United States Patent [19]

Knox

[11] Patent Number: 5,951,763

[45] Date of Patent: Sep. 14, 1999

[54] IMMERSIBLE ROTATABLE CAROUSEL APPARATUS FOR WETTING ARTICLES OF MANUFACTURE

[76] Inventor: David J. Knox, 10125 Greenleaf Ave., Santa Fe Springs, Calif. 90670

[21] Appl. No.: 09/020,488

[22] Filed: Feb. 9, 1998

[51] Int. Cl.[6] ..... B05C 3/02; B08B 3/00; C25D 17/00

[52] U.S. Cl. ..... 118/409; 134/142; 204/199

[58] Field of Search ..... 204/212, 213, 204/222, 199; 118/407, 409; 134/78, 157, 142

[56] References Cited

U.S. PATENT DOCUMENTS

| | | | |
|---|---|---|---|
| 4,003,805 | 1/1977 | Schaer et al. | 204/199 X |
| 4,734,179 | 3/1988 | Trammel | 204/222 X |
| 5,149,410 | 9/1992 | Robinson et al. | 204/199 |
| 5,234,562 | 8/1993 | Uenishi et al. | 204/199 |

*Primary Examiner*—Donald R. Valentine
*Attorney, Agent, or Firm*—Roth & Goldman

[57] ABSTRACT

An apparatus for immersing lightweight articles such as computer discs in a violently agitating electroplating bath comprises an immersible carousel driven for rotation from both ends of the carousel by a single drive means. The carousel is supported on easily replaceable bushings and comprises a pair of spaced wheels and a plurality of article support dowels which are individually rotated about their own axes during rotation of the carousel, the roratable dowels extending between the carousel end wheels, and the dowels being readily removable from the wheels for replacement of the articles to be electroplated. A positive locking means is provided for holding the dowels in position on the spaced carousel wheels without the necessity of spacer rods on the support carousel and the attendant interference with rapid removal of dowels and articles supported on the dowels which is caused when spacer rods are present.

7 Claims, 6 Drawing Sheets

IMMERSIBLE ROTATABLE CAROUSEL APPARATUS FOR WETTING ARTICLES OF MANUFACTURE

CROSS REFERENCE TO RELATED APPLICATIONS, IF ANY

None

BACKGROUND OF THE INVENTION AND PRIOR ART

Apparatus for immersing articles such as computer discs in a violently agitating electroplating bath have been described in detail in my prior U.S. Pat. No. 4,516,523 dated May 14, 1985. Computer discs are typically made of an aluminum substrate having an electrodeposited nickel plate intermediate layer and a surface layer of magnetic read/write material sputtered onto the nickel plate. Although the apparatus shown and described in my prior patent is generally suitable for electroplating computer discs, in recent years computer discs are increasingly becoming of smaller size and therefore are of considerably lighter weight. Lightweight articles are much more likely to move in a violently agitating electroplating bath on the dowels on which they are supported. Also, disc support dowels must be easily removed from the apparatus for unloading plated discs and reloading unplated disc substrates for electroplating with a minimum of effort and associate time which is involved. In my prior apparatus, spaced wheels at opposite ends of the immersible disc support carousel were connected to each other by a plurality of tie rods to maintain the discs in spaced relationship. These tie rods interfered with quick removal and placement of the support dowels with a fresh batch of discs to be coated. Also, the lighter weight smaller diameter discs of today's computer apparatus require the dowels to be positively locked in place at either side of the carousel like my prior apparatus where a dowel removal gap in a C-shaped dowel keeper ring was left uncovered.

In addition, the carousel support bearings must be frequently be replaced due to wear and rapid degradation in the electroplating bath.

OBJECTS OF THE INVENTION

It is accordingly an object of the invention to provide an immersible carousel apparatus with a plurality of easily removeable rotatable article support dowels which are firmly held in place by end wheels of a rotatable carousel during immersion of the carousel.

It is a further object to provide an article support carousel which is immersible in an electroplating bath and which does not require a plurality of connecting rods between end wheels of the carousel.

It is a further object to provide a dowel locking gate which is readily and easily movable to open and close a dowel loading and unloading gap in a C-shaped dowel keeper ring.

It is a further object to provide an article support carousel immersible in an electroplating bath and drive means engageable with the carousel at opposite ends of the carousel.

It is a further object to provide an article support carousel which is immersible in an electroplating bath and easily replaceable carousel support bushings.

SUMMARY OF THE INVENTION

The present invention accordingly provides an apparatus having an immersible rotatable carousel for wetting a plurality of articles of manufacture which are supported on at least one dowel, comprising:

a) a support frame having an immersible section;

b) an axle fixedly mounted on said support frame;

c) a pair of spaced carousel wheels mounted for rotation in unison on said axle, at least one of said wheels comprising a driven gear wheel, one of said wheels having a plurality of circumfrentially spaced bearing apertures therein, and the other of said wheels having a plurality of circumfrentially spaced radially extending recesses which are circumferentially aligned with said bearing apertures;

d) a sun gear fixedly mounted on said axle and disposed between said wheels;

e) a plurality of article support dowels each having a first bearing end received in one of said bearing apertures and a second bearing end received in one of said recesses, whereby said dowels are supported by said wheels and said dowels extend generally parallel to said axle to form a rotatable carousel;

f) each of said dowels having a planet gear affixed thereto and said planet gears having teeth in meshing engagement with external teeth on said sun gear whenever said dowels are received in said recesses and in said apertures;

g) drive means for rotating said driven gear wheel;

h) a stationary C-shaped keeper ring attached to said frame and substantially surrounding said wheel having said radially extending recesses therein, said keeper having a radially extending gap of width greater than the width of said recesses, said gap being disposed to extend generally upwardly; and i) moveable gate means for opening and closing said gap to retain said ends of said dowels in said recesses during rotation of said carousel.

BRIEF DESCRIPTION OF THE DRAWINGS

FIG. 2.

DESCRIPTION OF THE PREFERRED EMBODIMENT

Figure 1:
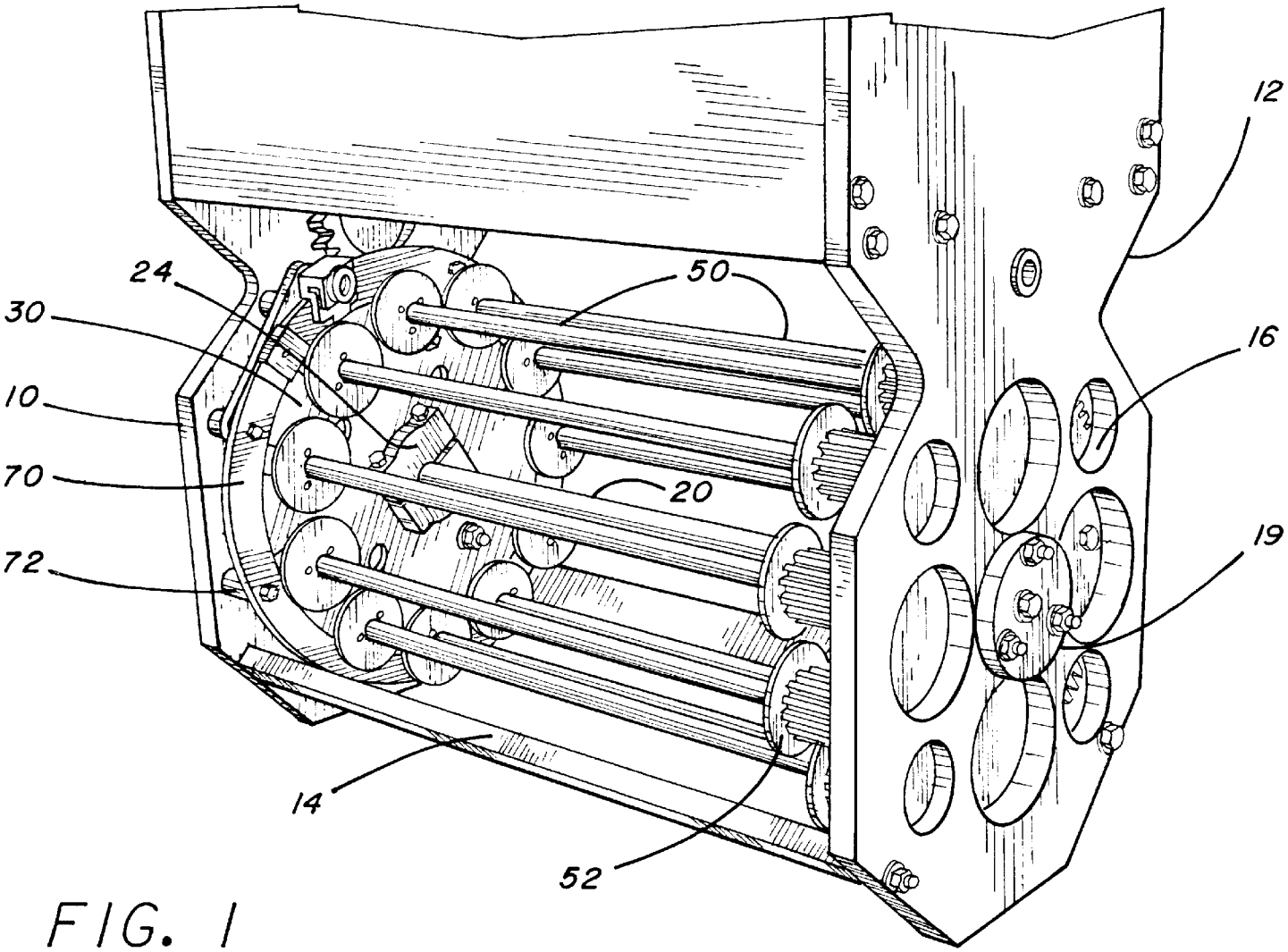
FIG. 1 is a perspective view of the invention.

FIG. 1 shows an immersible apparatus for wetting a plurality of articles of manufacture such as magnetic computer discs in a fluid electroplating bath. The apparatus is comprised of a frame having an immersible lower section defined by a pair of spaced plastic side plates 10, 12 which are held in spaced relationship by one or more transversely extending spacers 14. The spaced side plates are preferably provided with a plurality of fluid circulation cutouts 16. A rigid carousel support axle 20 has at least one, and preferably two non-rotatable sun gears 40 fastened to the axle 20 proximate the ends thereof by longitudinally extending bolts 25 which extend parallel to the axle 20 through split block axle clamps 24, 26 at the opposite ends of the axle. The split blocks are also fastened to each other and thus clamped to the axle by additional transversely extending bolts 25.

A pair of axially spaced carousel wheels 30, 32 are rotatably mounted on the ends of the axle 20 by bushings 16 which are received an access apertures 14 in the frame sideplates 10, 12. Bushings 16 are axially confined between a pair of thrust washers 17 disposed on opposite sides of the sun gear 40. Washers 17 have a diameter greater than the diameter of the access aperture 14 so that one of the washers 17 engages an inside surface of the respective frame sideplate 10 or 12 whereby the sun gear, thrust washers and bushings are confined between the split axle blocks and the frame. This permits easy removal and replacement of the bushings 16 by first removing access plates 19 which cover the access apertures 14 and subsequently disconnecting the split locking blocks 26 from the axle 20.

Figure 3:
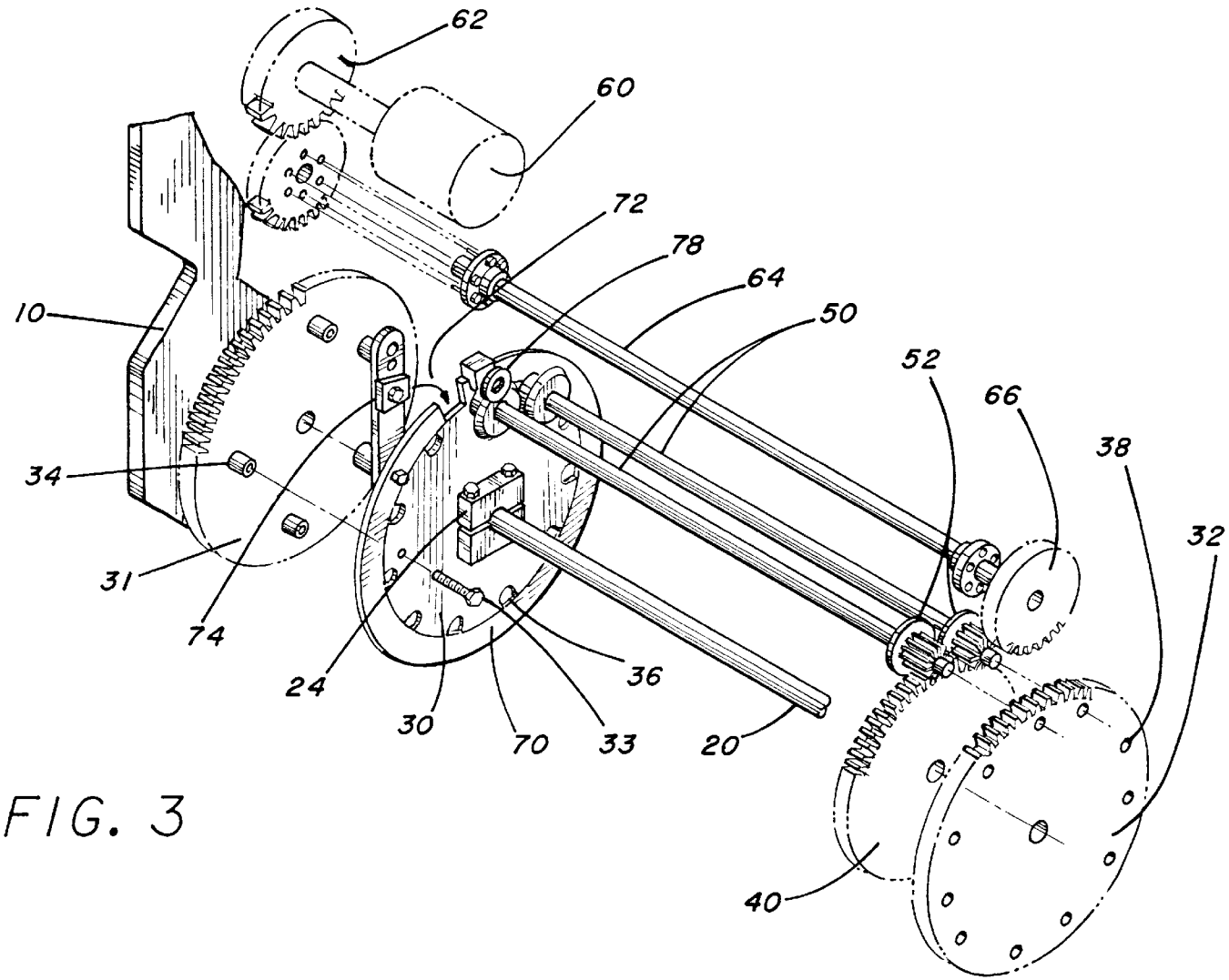
FIG. 3 is an exploded partial perspective view of the invention.
Figure 4:
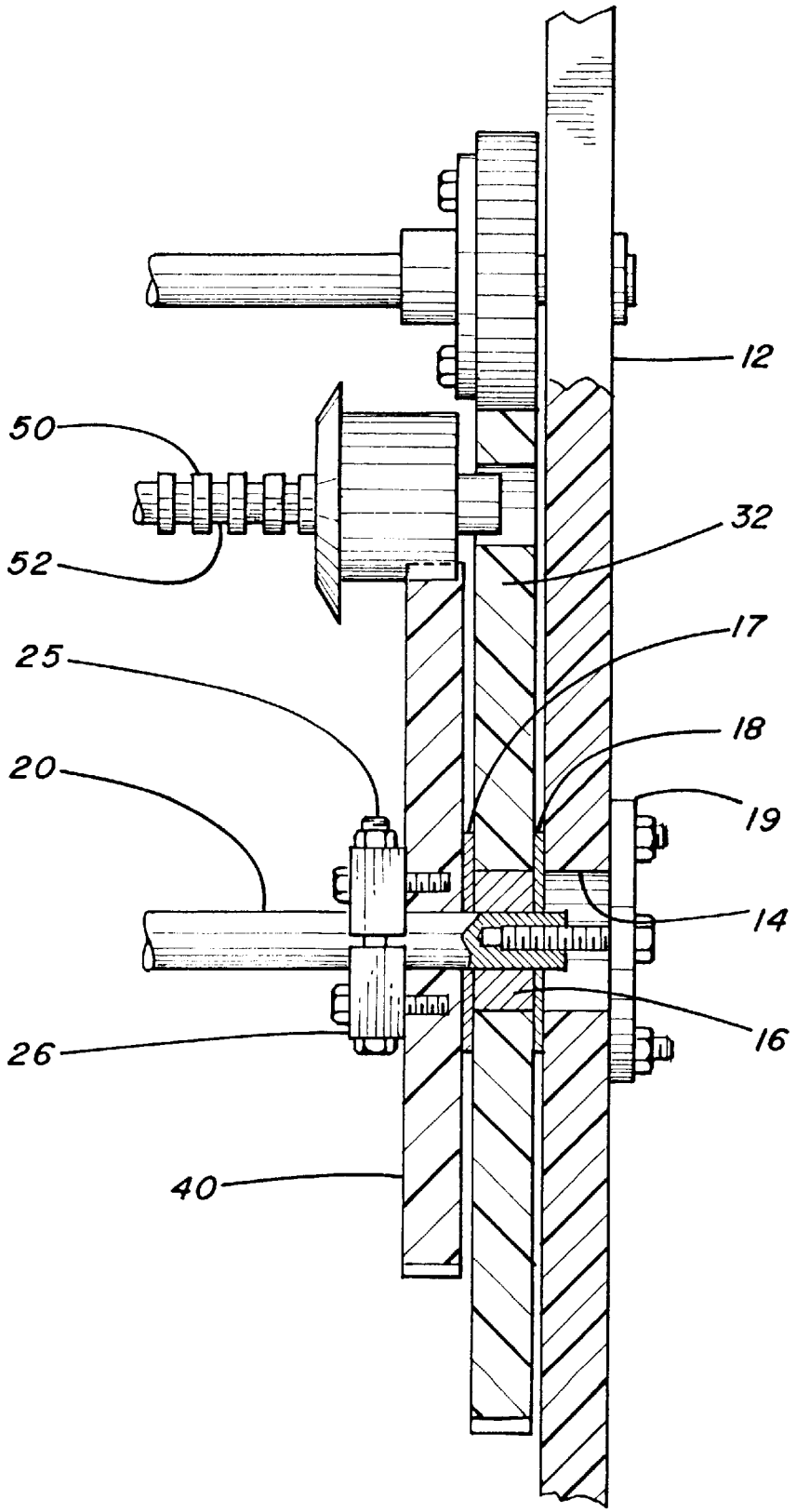
FIG. 4 is a partial right side front elevation cross section of the invention as viewed in FIG. 1.
Figure 5:
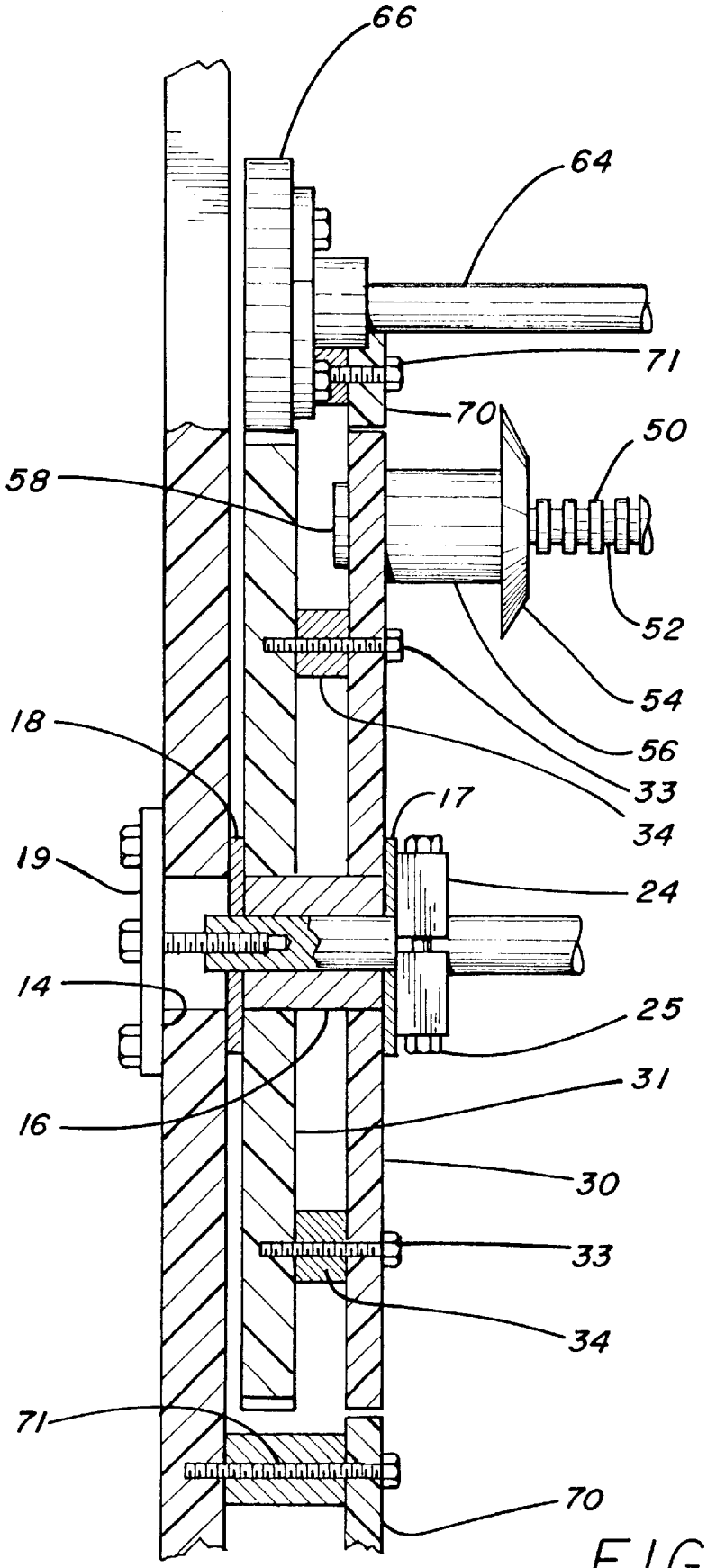
FIG. 5 is a partial left side front elevation cross section of the invention as viewed in FIG. 1.

The immersible disk support carousel is comprised of the spaced wheels 30, 32 and a plurality of removable disk support dowels 50 supported on and extending between the wheels 30, 32 in a manner to be described. Preferably, a second peripherally toothed driven gear 31 is spaced from and attached to carousel wheel 30 by a plurality of bolts 33 and spacers 34 as seen in FIG. 5. Provision of a separate driven gear 31 in addition to driven wheel 32 permits the carousel to be rotated by engagement with drive gears 66 at both ends of the carousel. The drive gears are preferably mounted on a common drive shaft 64 and are driven by an electric motor 60 and suitable gear transmission 62 as shown in FIG. 3.

One end of each article support dowel 50 has a planet gear 52 affixed thereto (at the right end as seen in FIG. 1) for engagement with the fixed sun gear 40 such that the dowels rotate about their own axes as the carousel rotates on axle 20.

Figure 6:
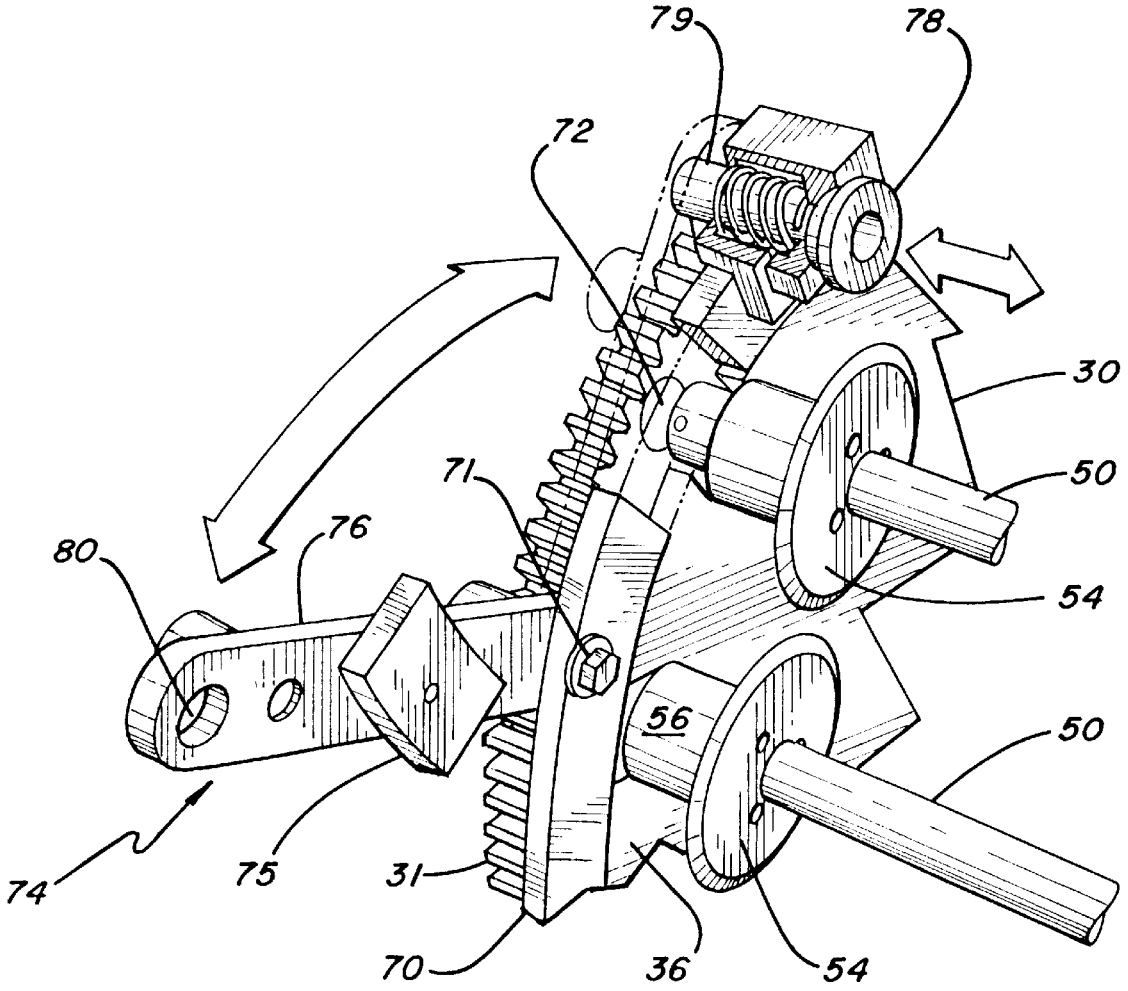
FIG. 6 is a perspective view, to an enlarged scale, of a keeper ring gate.

The right hand ends of the dowels 50 are received in a plurality of circumfrentially spaced dowel apertures 38 in the driven wheel 32. The other ends of the dowels 50 have support bearings thereon which include an end flange 54, spacers 56 and dowel bearing ends 58 which are in turn received in radially extending round bottom recesses 36 in the carousel wheel 30 as best seen in FIGS. 5 and 6.

Reception of the opposite ends of the dowels 50 in the apertures 38 and recesses 36 permits the dowels to be removably supported on the spaced carousel wheels 30, 32 and to extend in a direction generally parallel to the axle 20.

Figure 2:
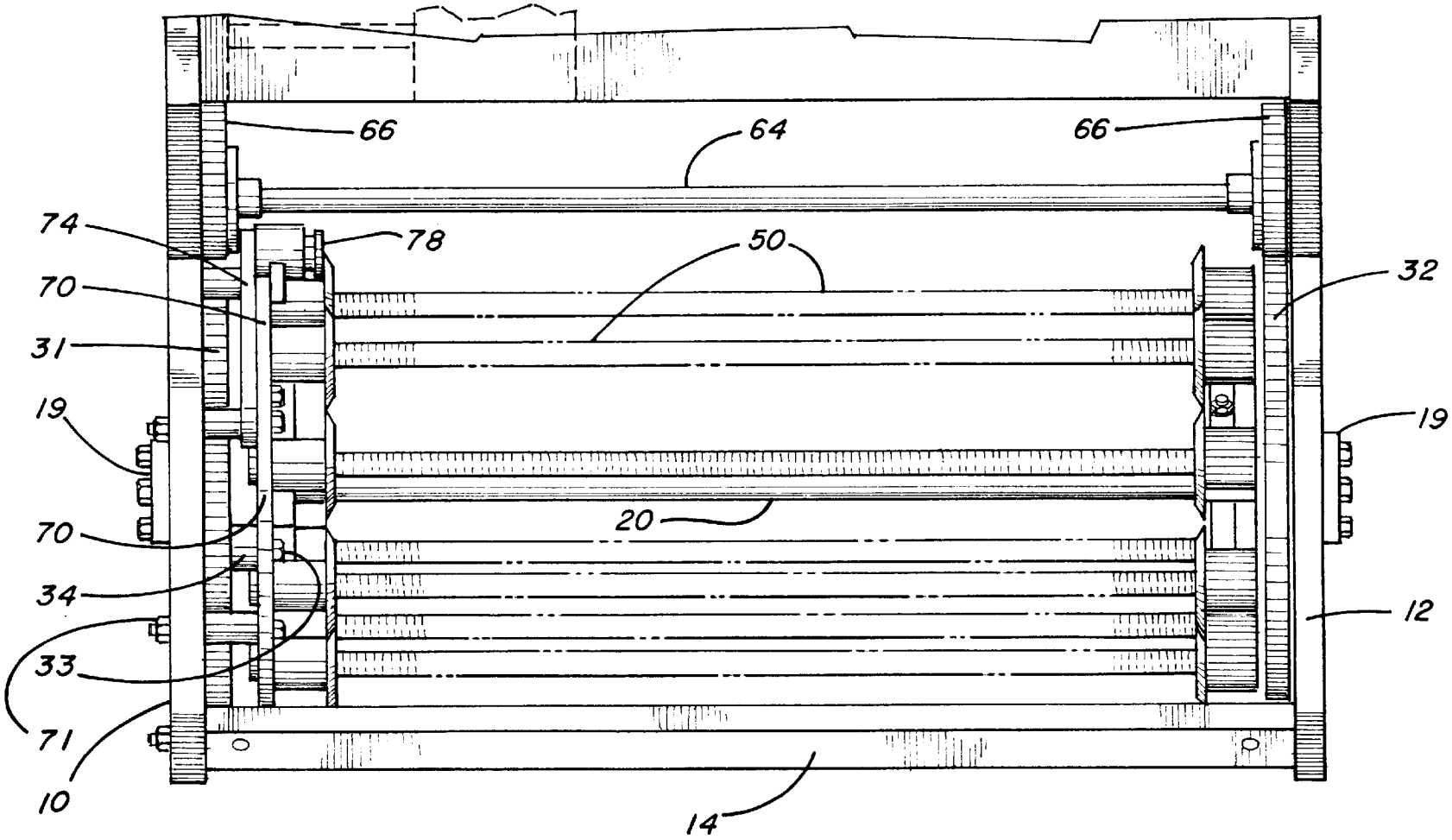
FIG. 2 is a front elevation view of the invention.

A stationary C-shaped keeper ring 70 substantially surrounds rotatable carousel wheel 30 to confine the ends of the dowels 50 in the radially extending recesses 36 during rotation of the carousel. As seen in FIGS. 2 and 5, the keeper ring 70 is attached by bolts and spacers 71 to frame side plate 10. At an upper front accessible portion of the apparatus, the keeper ring 70 has a dowel clearance gap 72 which in turn receives a dowel keeper gate 74 for opening and closing the gap 72. The gate 74 comprises a block 75 having a concave arcuate surface of slightly larger radius than the radius of the carousel wheel 30, the gate block 75 being pivotally affixed to a gate arm 76 which is in turn pivotally affixed to one of the bolts 71 which fasten the C-shaped keeper ring 70 to the frame sideplate 10. Preferably, the gate block 75 is locked in place by a lock in the form of a grippable spring loaded detent pin 78 mounted for movement in the block 74, the pin having an end 79 which is receivable in a hole 80 in the mounting arm 76 to lock the gate block 75 in the dowel clearance gap 72 in keeper 70.

Although not forming part of the invention, the carousel drive including the motor 60 and transmission 62 can be mounted in a fluid-tight immersible housing supported on the upper portion of the frame (not shown).

Each of the dowels 50 is preferably made of a springy plastic such as Teflon® and has a plurality of spaced parallel grooves 52 for respectively holding one of a plurality of wettable computer discs or other articles to be immersed in a metal electroplating bath. As the motor 60 and transmission 62 rotate the drive shaft 64, the drive gears 66 at opposite ends of the drive shaft respectively engage the external gear teeth on the carousel wheel 32 and the driven gear 31 affixed to carousel wheel 30 for rotating the entire carousel as a unit. Simultaneously, the planet gears 52 on the opposite ends of the article support dowels 50 also cause the dowels to rotate about their own axes due to engagement of the gear teeth on the planet gears 52 with the external gear teeth on the fixed sun gear 40. Thus, discs supported for immersion in an electroplating bath are rotated with the dowels about their own central apertures and are further circulated through the violently agitating bath due to rotation of the carousel.

The dowels 50 may easily be removed to mount and remove discs therefrom by opening the gate 74 which permits one end of a dowel 50 positioned in gap 72 to be radially removed from its mounting recess 36 in wheel 30 following which the other end of the dowel is removed from its bearing aperture 38 in the driven wheel 32 by axial movement.

It will be noted that the carousel does not include tie rods extending between the end wheels 30, 32 since the end wheels 30, 32 are each mounted and held in their respective positions on the axle 20 by the spaced washers 17, 18 and the easily removably split axle clamps 24, 26.

Persons skilled in the art will readily appreciate that various modifications can be made from the preferred embodiment thus the scope of protection is intended to be defined only by the limitations of the appended claims.

I claim:

1. An apparatus having an immersible rotatable carousel for wetting a plurality of articles of manufacture which are supported on at least one dowel, comprising:

a) a support frame having an immersible section;

b) an axle fixedly mounted on said support frame;

c) a pair of spaced carousel wheels mounted for rotation in unison on said axle, at least one of said wheels comprising a driven gear wheel, one of said wheels having a plurality of circumfrentially spaced bearing apertures therein, and the other of said wheels having a plurality of circumferentially spaced radially extending recesses which are circumferentially aligned with said bearing apertures;

d) a sun gear fixedly mounted on said axle and disposed between said wheels;

e) a plurality of article support dowels each having a first bearing end received in one of said bearing apertures and a second bearing end received in one of said recesses, whereby said dowels are supported by said wheels and said dowels extend generally parallel to said axle to form a rotatable carousel;

f) each of said dowels having a planet gear affixed thereto and said planet gears having teeth in meshing engagement with external teeth on said sun gear whenever said dowels are received in said recesses and in said apertures;

g) drive means for rotating said driven gear wheel;

h) a stationary C-shaped keeper ring attached to said frame and substantially surrounding said wheel having said radially extending recesses therein, said keeper having a radially extending gap of width greater than the width of said recesses, said gap being disposed to extend generally upwardly; and i) moveable gate means for opening and closing said gap to retain said ends of said dowels in said recesses during rotation of said carousel.

2. The apparatus of claim 1, wherein each of wheels is a driven gear wheel, said drive means comprising drive gears engaging each of said gear wheels.

3. The apparatus of claim 2, further comprising spaced bushings supporting said driven gear wheels for rotation on said axle, said frame having access apertures aligned with said axle and said bushings and removable access plates covering said apertures for replacement of said bushings.

4. The apparatus of claim 3, further comprising thrust washers mounted on said axle in abutment with axially opposite sides of said bushings, and removable split locking blocks affixed to said axle to confine said sun gear, said thrust washers and said bushings between said locking blocks and said frame.

5. The apparatus of claim 1, wherein said gate means comprises a block having a concave arcuate surface of slightly larger radius than the radius of said wheel having said recesses therein, said gate block being pivotally affixed to a support arm and said arm being pivotally mounted on said frame.

6. The apparatus of claim 5, further comprising a gate lock comprising a grippable spring loaded detent pin mounted for movement in said block, said pin being receivable in a hole in said arm for locking said gate block in said keeper gap.

7. The apparatus of claim 1, wherein said frame has a pair of spaced end plates and further comprising a plurality of fluid circulation cutouts in said end plates.

* * * * *